US011634955B2

(12) United States Patent
Durst et al.

(10) Patent No.: US 11,634,955 B2
(45) Date of Patent: Apr. 25, 2023

(54) SELF-ORIENTING SELECTIVE LOCKABLE ASSEMBLY TO REGULATE SUBSURFACE DEPTH AND POSITIONING

(71) Applicant: Halliburton Energy Services, Inc., Houston, TX (US)

(72) Inventors: Douglas Glenn Durst, Jersey Village, TX (US); Calvin Barnard Ponton, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/304,817

(22) Filed: Jun. 25, 2021

(65) Prior Publication Data

US 2021/0317715 A1 Oct. 14, 2021

Related U.S. Application Data

(63) Continuation of application No. 16/465,794, filed as application No. PCT/US2017/019785 on Feb. 27, 2017, now Pat. No. 11,078,737.

(51) Int. Cl.

| | |
|---|---|
| ***E21B 23/01*** | (2006.01) |
| ***E21B 23/02*** | (2006.01) |
| ***E21B 23/00*** | (2006.01) |
| ***E21B 43/10*** | (2006.01) |
| *E21B 23/06* | (2006.01) |
| *E21B 33/12* | (2006.01) |
| *E21B 47/024* | (2006.01) |

(52) U.S. Cl.

CPC ..... *E21B 23/01* (2013.01); *E21B 23/004* (2013.01); *E21B 23/02* (2013.01); *E21B 23/06* (2013.01); *E21B 33/12* (2013.01); *E21B 43/10* (2013.01); *E21B 47/024* (2013.01)

(58) Field of Classification Search

CPC ..... E21B 23/004; E21B 23/01; E21B 23/02

See application file for complete search history.

(56) References Cited

U.S. PATENT DOCUMENTS

| | | | |
|---|---|---|---|
| 3,507,329 | A | 4/1970 | Stone, Jr. |
| 3,670,821 | A | 6/1972 | Tamplen |

(Continued)

FOREIGN PATENT DOCUMENTS

| | | | |
|---|---|---|---|
| RU | 2323323 | C2 | 4/2008 |
| WO | 0188336 | A1 | 11/2001 |
| WO | 2011159890 | A2 | 12/2011 |

OTHER PUBLICATIONS

PCT Application Serial No. PCT/US2017/019785, International Preliminary Report on Patentability (Chapter II), dated Feb. 1, 2019, 4 pages.

(Continued)

*Primary Examiner* — Jennifer H Gay

(74) *Attorney, Agent, or Firm* — Delizio, Peacock, Lewin & Guerra

(57) ABSTRACT

A well tool to be oriented and secured in a wellbore without the external application of torque, and a well system incorporating the same. After installation of orientation casing and universal latch coupling casing, the self-orienting selective lockable latch well tool is run downhole to the target depth, picked up to free the internal locking mechanism, and then loaded with downhole stress to engage the locking mechanism.

19 Claims, 10 Drawing Sheets

(56) References Cited

U.S. PATENT DOCUMENTS

| | | | | |
|---|---|---|---|---|
| 3,990,510 | A | 11/1976 | Decuir | |
| 4,161,984 | A | 7/1979 | Watkins | |
| 4,355,825 | A | 10/1982 | Leicht | |
| 5,156,209 | A * | 10/1992 | McHardy | E21B 23/02 166/324 |
| 5,348,087 | A | 9/1994 | Williamson, Jr. | |
| 5,467,819 | A | 11/1995 | Braddick | |
| 5,579,829 | A | 12/1996 | Comeau et al. | |
| 6,012,527 | A | 1/2000 | Nitis et al. | |
| 6,230,806 | B1 | 5/2001 | Gano | |
| 6,283,208 | B1 | 9/2001 | George et al. | |
| 6,499,537 | B1 | 12/2002 | Dewey et al. | |
| 6,554,062 | B1 | 4/2003 | Dewey et al. | |
| 6,648,069 | B2 | 11/2003 | Dewey et al. | |
| 6,808,022 | B2 | 10/2004 | Smith | |
| 6,907,935 | B2 | 6/2005 | Smith | |
| 6,935,428 | B2 | 8/2005 | McGlothen et al. | |
| 6,935,431 | B2 | 8/2005 | Dewey et al. | |
| 7,000,704 | B2 | 2/2006 | Smith | |
| 8,408,291 | B2 | 4/2013 | Pendleton et al. | |
| 8,590,608 | B2 | 11/2013 | Linn et al. | |
| 8,678,097 | B1 | 3/2014 | Telfer et al. | |
| 9,140,081 | B2 | 9/2015 | Telfer et al. | |
| 10,557,331 | B2 | 2/2020 | Rodriguez et al. | |
| 11,078,737 | B2 * | 8/2021 | Durst | E21B 23/02 |
| 2002/0148617 | A1 | 10/2002 | Dewey et al. | |
| 2002/0162656 | A1 | 11/2002 | Dewey | |
| 2004/0020648 | A1 | 2/2004 | Dewey et al. | |
| 2004/0149452 | A1 | 8/2004 | Pendleton | |
| 2005/0155770 | A1 | 7/2005 | Parrott | |
| 2011/0232898 | A1 | 9/2011 | Pendleton et al. | |
| 2012/0012338 | A1 * | 1/2012 | Blanton | E21B 23/02 166/217 |
| 2012/0261130 | A1 | 10/2012 | Linn et al. | |
| 2014/0144617 | A1 | 5/2014 | Telfer et al. | |
| 2014/0144619 | A1 | 5/2014 | O'Brien | |
| 2016/0273290 | A1 | 9/2016 | Harms | |
| 2018/0163486 | A1 * | 6/2018 | Davies | E21B 23/01 |
| 2018/0187519 | A1 | 7/2018 | Rodriguez et al. | |
| 2019/0390526 | A1 | 12/2019 | Durst et al. | |
| 2021/0317715 | A1 * | 10/2021 | Durst | E21B 23/004 |

OTHER PUBLICATIONS

PCT Application No. PCT/US2017/019785, International Search Report dated Nov. 23, 2017, 3 pages.

PCT Application No. PCT/US2017/019785, Written Opinion dated Nov. 23, 2017, 4 pages.

Russian Application Serial No. 2019120413; First Office Action; dated Jun. 3, 2020, 9 pages including English translation.

* cited by examiner

SELF-ORIENTING SELECTIVE LOCKABLE ASSEMBLY TO REGULATE SUBSURFACE DEPTH AND POSITIONING

BACKGROUND

The disclosure generally relates to the field of subsurface operations, and more particularly to a self-orienting selective lockable assembly to regulate subsurface depth and positioning.

An anchoring device (e.g., a packer or liner hanger) may be set in a casing string in a parent wellbore and inhibit movement of itself or attached tools. An anchoring device may be useful for downhole applications requiring an immobile subsurface platform. An anchoring device can act as a seal and provide pressure isolation for a zone of a parent wellbore below an intersection with a branch wellbore. In some applications, an anchoring device can be a secure platform upon which a whipstock is attached when milling through the casing of the parent wellbore and drilling the branch wellbore.

BRIEF DESCRIPTION OF THE DRAWINGS

Embodiments of the disclosure may be better understood by referencing the accompanying drawings.

DESCRIPTION

The description that follows includes example systems, methods, techniques, and operations that embody aspects of the disclosure. However, it is understood that this disclosure may be practiced without these specific details. For instance, this disclosure refers to a system application for subsurface operations. But aspects of this disclosure can be also applied to various other types of applications that are above surface. In other instances, well-known structures and techniques have not been shown in detail in order not to obfuscate the description.

Various embodiments include a set of tools or components that can be combined into an assembly that can be lowered to a downhole/subsurface location such that there is control of both depth and azimuthal positioning of devices attached to the assembly. Such control can be provided without rotation, from the surface or at any point along the wellbore such as via tubing, pipe, or other mechanisms. The attached devices can include various bottom hole assemblies (BHAs) that can require specific depth and more importantly azimuthal or directional control. An example of a BHA includes a whipstock, which may be used to deflect drill bits towards a new direction by guiding a drill bit through a milling window on the whipstock.

In some embodiments, the combined assembly can be a self-orienting selective lockable latch assembly. Relative orientation between this assembly and the attached device can be established at the surface. After the assembly and the attached device are lowered downhole and the assembly is locked in place, the attached device is positioned at the proper depth and azimuthal orientation to allow the attached device to perform its operation properly. As further described below, this proper depth and azimuthal orientation of the assembly and attached device can be performed without tubing rotation from the surface. Accordingly, various embodiments do not require the application of torque to the downhole tubing to provide proper depth and azimuthal orientation.

Additionally, for the self-orienting selective lockable latch assembly, there are no pre-alignment (orientation or otherwise) requirements relative to any of its components. Rather, there can be alignment requirements relative to devices being attached to the assembly. Also, as further described below, various embodiments allow for the locking of the assembly to support and resist both upward and downward movement while in operation.

Example System

Figure 1A:
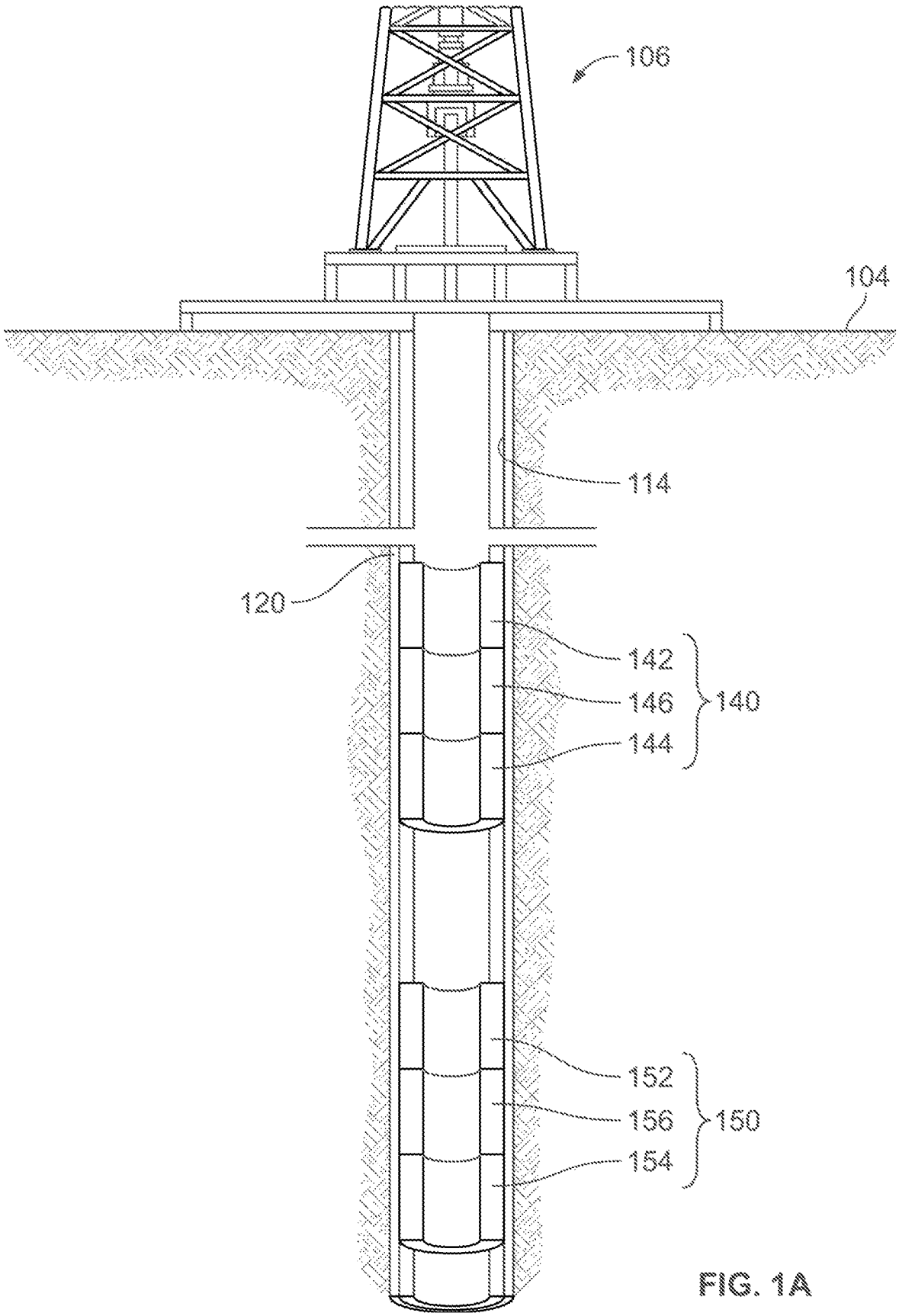
FIG. 1A depicts a schematic diagram of a well system making use of a self-orienting lockable latch assembly, according to some embodiments.
Figure 1B:
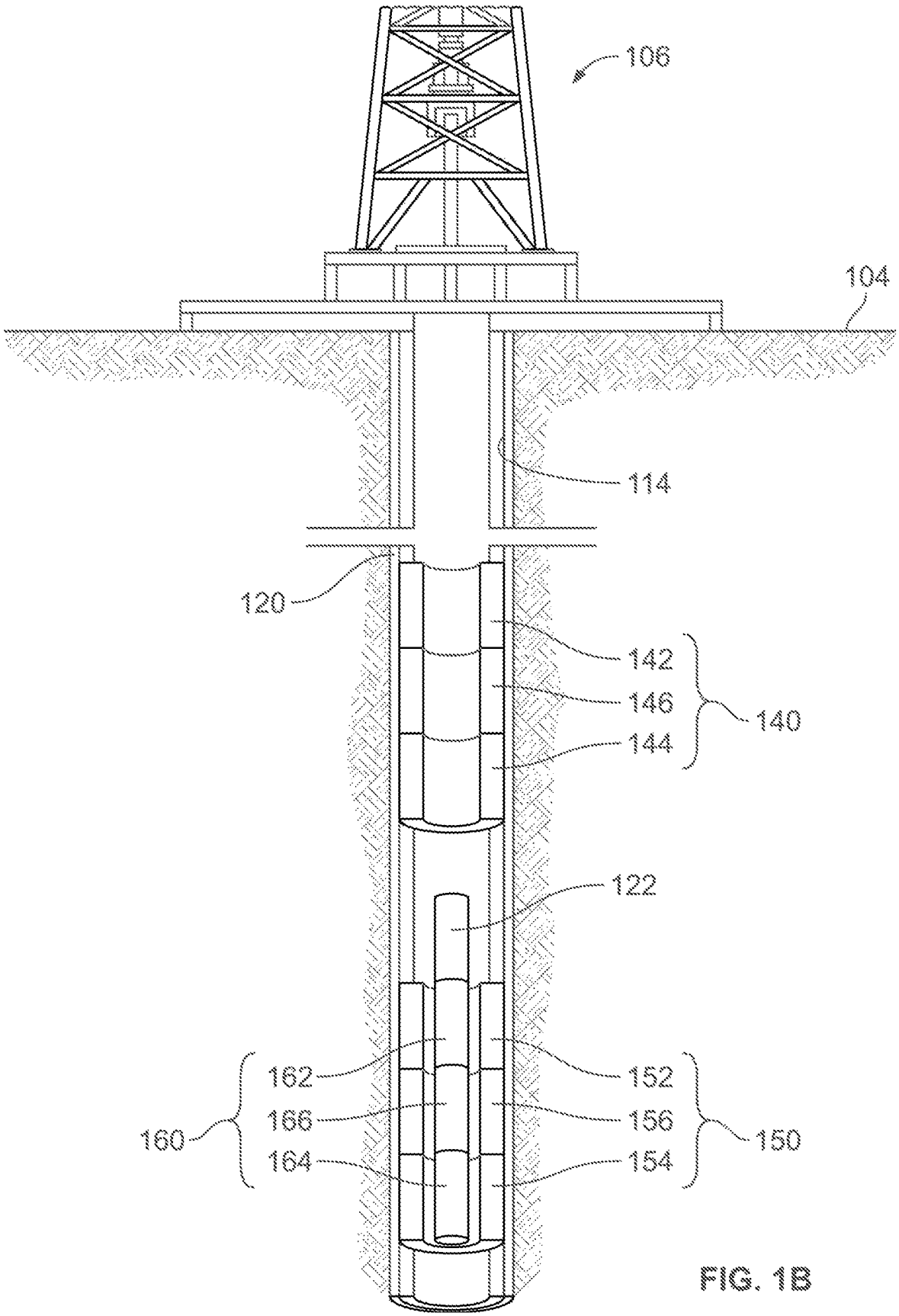
FIG. 1B depicts a schematic diagram of the well system of FIG. 1A after inserting the self-orienting selective lockable latch tool into the orientation housing and latch coupling downhole, according to some embodiments.

FIG. 1A depicts a schematic diagram of a well system making use of a self-orienting lockable latch assembly, according to some embodiments. FIG. 1A depicts an example of a well system after the vertical wellbore 114 has been drilled and the drillstring has been removed. FIG. 1 A depicts the well system after inserting a wellbore tubular system 120 (that includes casing integrated with latch orientation housings). Additionally, FIG. 1A depicts the well system that is prior to lowering and locking a self-orienting selective lockable latch tool 160 (depicted in FIG. 1B) into position using one of the latch orientation housings. In this example, part of the casing of the wellbore 114 includes an upper latch orientation housing 140 and a lower latch orientation housing 150. In other words, the casing, the upper latch orientation housing 140 and the lower latch orientation housing 150 are part of the wellbore tubular system 120. The lower latch orientation housing 150 is comprised of a latch coupling 152, orientation housing 154 and, optionally, a set of spacer casing 156. As further described below, this integration of the orientation housing and latch coupling into the casing allows for the self-orienting selective lockable latch tool 160 to be selectively run through or locked into the upper latch orientation housing 140 and the lower latch orientation housing 150. The self-orienting selective lockable latch tool 160 can be locked into either the upper latch orientation housing 140 or the lower latch orientation housing 150 depending on operations for lowering and positioning the self-orienting selective lockable latch tool 160 into the wellbore 114, as further described below. In other words, the self-orienting selective lockable latch tool is not required to be unique to a particular latch orientation housing. Rather, in some embodiments, a same self-orienting selective lockable latch tool is usable with different latch orientation housings located at different locations along the casing of the wellbore 114.

The well system includes a platform 106 positioned on the earth's surface 104 and extending over and around the wellbore 114. The wellbore 114 extends vertically from the earth's surface 104. The lower latch orientation housing 150 can include, optionally, a set of spacer casing 156 may be used to extend the length between the latch coupling 152 and orientation housing 154, which may enhance stability of the well system during running or locking procedure.

The upper latch orientation housing 140 includes an upper latch coupling 142, an upper orientation housing 144, and, optionally, an upper set of spacer casing 146. The upper latch orientation housing 140 is positioned above the latch orientation housing 150. As will be expanded in the descriptions below, this upper latch orientation housing 140 may allow the self-orienting selective lockable latch tool 160 to pass through without engaging any locking mechanisms or causing irreversible damage to the self-orienting selective lockable latch tool 160. Before installation of the self-orienting selective lockable latch tool 160, the wellbore tubular system 120 may be surveyed in order to help plan the azimuthal directions of the self-orienting lockable latch tool 160, especially with regards to the azimuthal direction of the orientation housing 154 and the upper orientation housing 144.

FIG. 1B depicts a schematic diagram of the well system of FIG. 1A after inserting the self-orienting selective lockable latch tool into the orientation housing and latch coupling downhole, according to some embodiments. In particular, FIG. 1B depicts a schematic diagram of the well system of FIG. 1A after inserting a self-orienting selective lockable latch tool 160 into the latch orientation housing 150. The self-orienting selective lockable latch tool 160 is comprised of a selective lockable latch tool 162, an orientation tool 164 and, optionally, a spacer tubular 166. The lengths of the spacer casing 156 and the spacer tubular 166 may be similar such that the selective lockable latch tool 162 may be positioned within the latch coupling 152 while the orientation tool 164 is positioned within the orientation housing 154. Various other tools may be locked into any planned azimuthal position by being attached to the self-orienting selective lockable latch tool 160. In an example downhole operation, a whipstock tool 122 may be attached to the self-orienting selective lockable latch tool 160 and lowered down the wellbore 114, through the upper latch orientation housing 140. At the upper latch orientation housing 140, only a downward force is applied and the locking mechanisms in the selective lockable latch tool 162 are not activated.

The self-orienting selective lockable latch tool 160 will be lowered until the tool has been lowered to the depth of the latch orientation housing 150. After performing a locking operation to be described below, the self-orienting selective lockable latch tool 160 is locked to the latch orientation housing 150. Though the upper latch coupling 142 and the latch coupling 152 are identical in FIG. 1B, the self-orienting selective lockable latch tool 160 is not prevented from being lowered and locked into the latch orientation housing 150 by the upper latch coupling 142. The capability for this system to use multiple identical latch couplings in the same well system contributes to the locking design being universal.

This capability of the self-orienting selective lockable latch tool 160 to be universally compatible with a plurality of potential latch couplings in the well provides greater design flexibility for initial well planning or later well projects. In this case, a well project may rely on the self-orienting selective lockable latch tool 160 to run through latch couplings not at the target depth such as the upper latch orientation housing 140 without locking. When the self-orienting selective lockable latch tool 160 is lowered to the target position, upward loading is applied to return the self-orienting selective lockable latch tool 160 to the target position. For example, upward loading may be applied onto a drillstring attached to the top the self-orienting selective lockable latch tool 160, wherein the tool may be moved upward toward the earth's surface 104. As this upward loading is applied, the orientation tool 164 will ensure that the self-orienting selective lockable latch tool 160 remains oriented in a planned direction during any operation due to the rotational force exerted on the orientation tool 164 by the orientation housing 154. As further described below, further upward load will activate an internal support decoupling mechanism in the selective lockable latch tool 162 and subsequent run-in loading will lock the tool in place. This will prevent axial motion of the self-orienting selective lockable latch tool 160 and the whipstock tool 122. During the entirety of the locking operation, only axial force was applied and the locking operation did not require exertion of torque from the surface. Once locked, the self-orienting selective lockable latch tool 160 may be used to provide a stable platform to ensure positive regulation of depth and azimuthal positioning for the whipstock or any other attached tools without further intervention or surface manipulation.

Example Self-Orienting Selective Lockable Latch Tool

Figure 2:
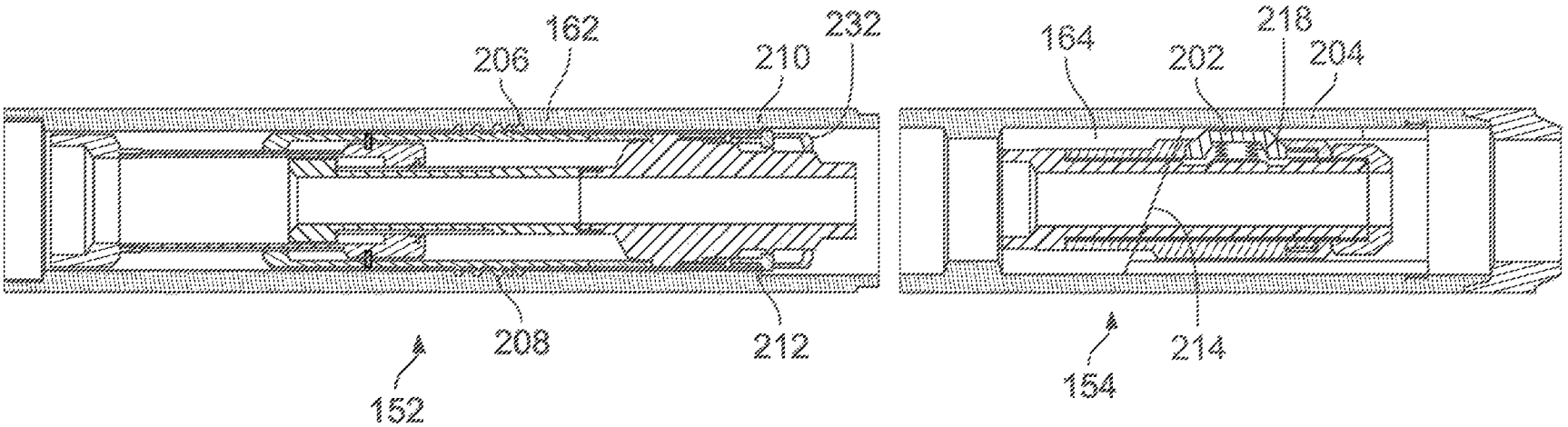
FIG. 2 depicts a longitudinal cross-sectional view of some of the elements of the self-orienting selective lockable latch assembly, according to some embodiments.
Figure 3:
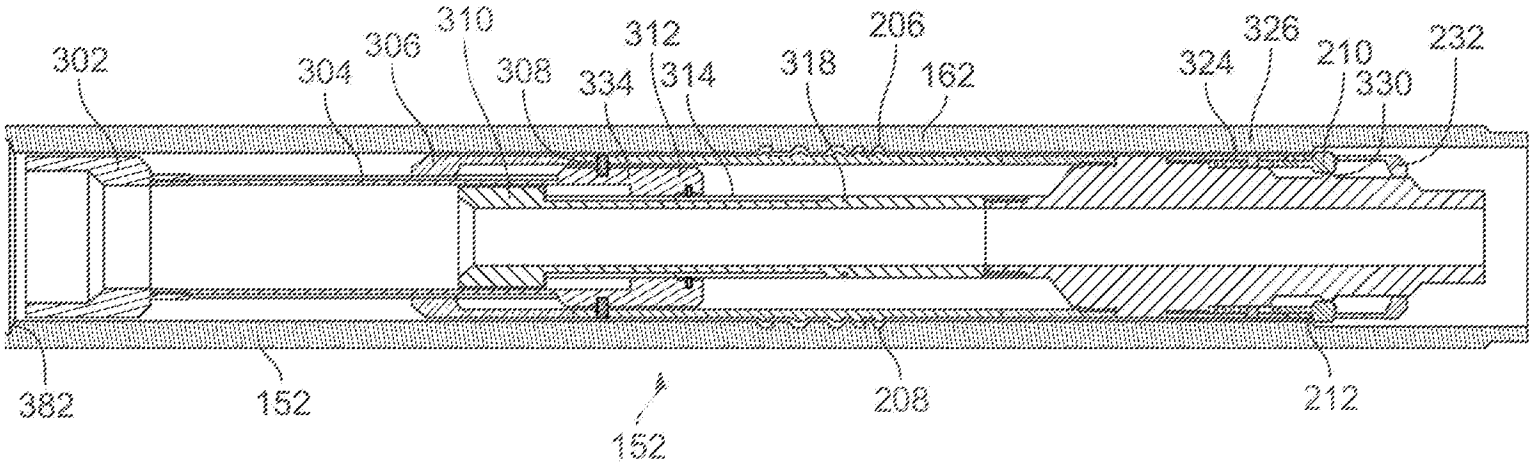
FIG. 3 depicts a longitudinal cross-sectional view of a selective lockable latch tool in a running configuration within a universal latch coupling, according to some embodiments.
Figure 4:
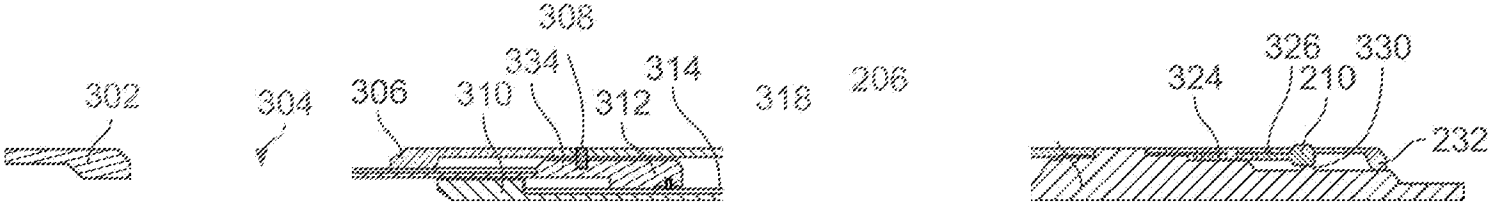
FIG. 4 depicts a longitudinal cross-sectional view of a wall for the selective lockable latch tool in the running configuration, according to some embodiments.
Figure 5:
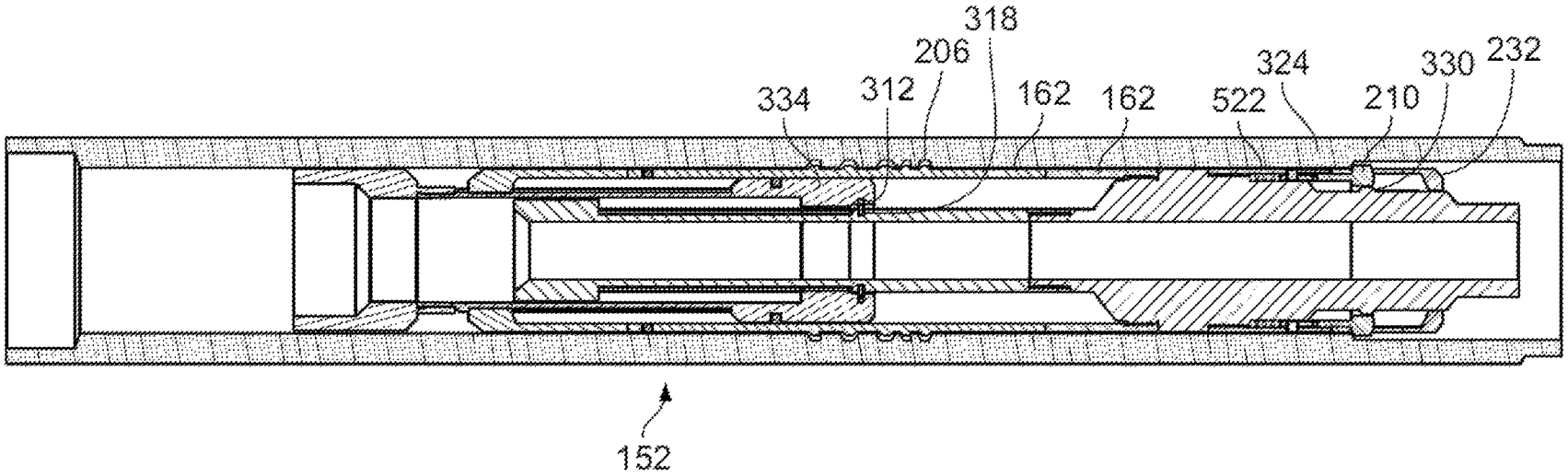
FIG. 5 depicts a longitudinal cross-sectional view of the selective lockable latch tool in the locked configuration inside of the universal latch coupling, according to some embodiments.
Figure 6:
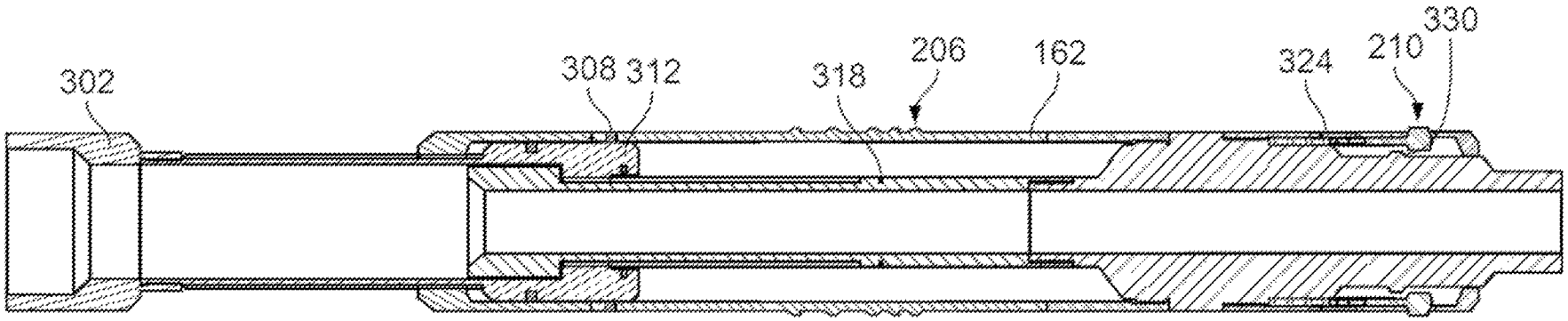
FIG. 6 depicts a longitudinal cross-sectional view of the selective lockable latch tool in a released configuration, according to some embodiments.
Figure 8:
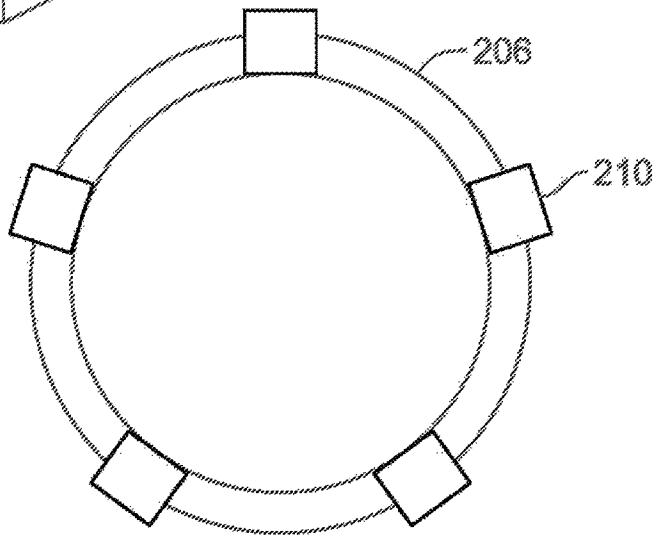
FIG. 8 depicts a radial view of an orientation key fitted within a selective lockable latch, according to some embodiments.
Figure 7:
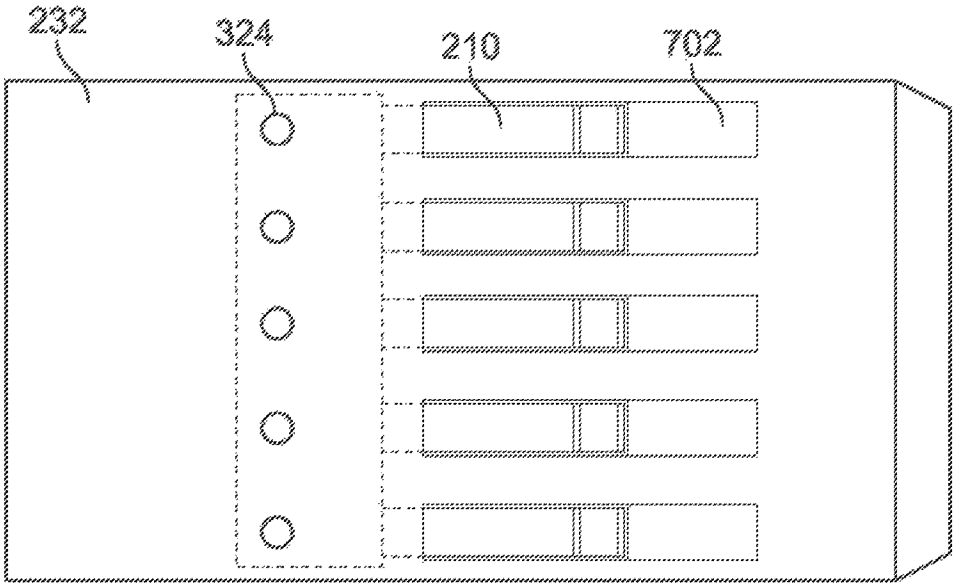
FIG. 7 depicts a top view of the dog segment of the selective lockable latch tool if the segment was isolated, according to some embodiments.
Figure 9:
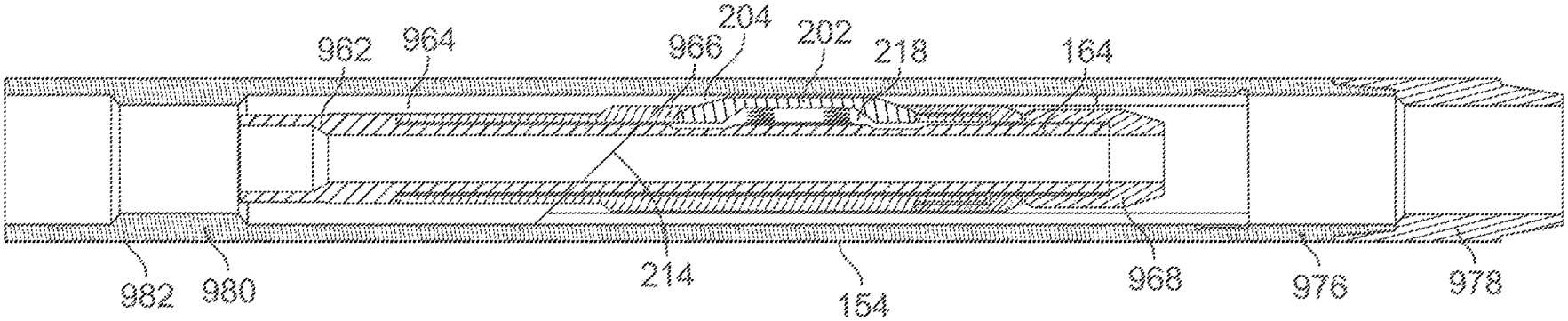
FIG. 9 depicts a longitudinal cross-sectional view of an orientation tool positioned within an orientation housing, according to some embodiments.
Figure 10:
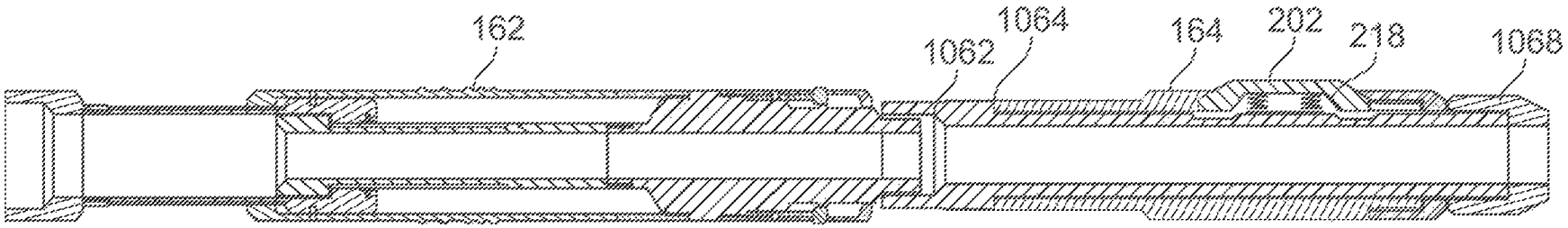
FIG. 10 depicts a longitudinal cross-sectional view of a self-orienting selective lockable latch tool, according to some embodiments.
Figure 11:
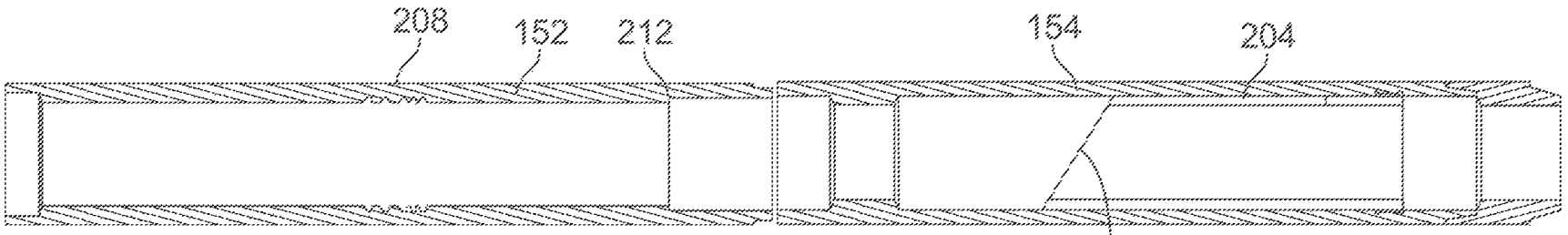
FIG. 11 depicts a longitudinal cross-sectional view of a universal latch orientation housing, according to some embodiments.
Figure 12:
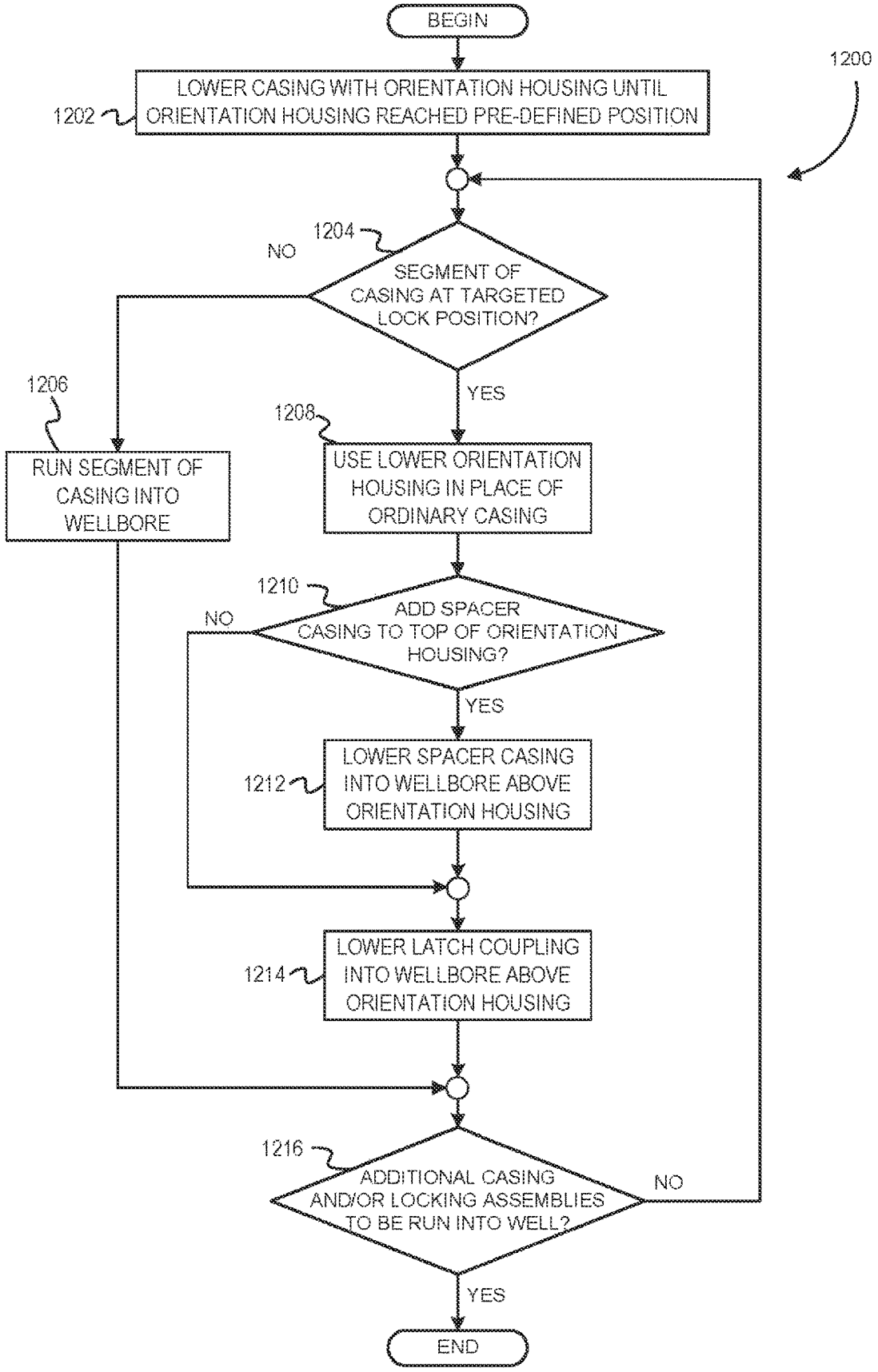
FIG. 12 depicts a flowchart of operations to install the casing string and universal latch orientation housing, according to some embodiments.

The following figures will depict various elements first illustrated in FIG. 1 in various configurations. FIG. 2 will illustrate the self-orienting selective lockable latch tool 160, which is comprised of the orientation tool 164 and the selective lockable latch tool 162, positioned inside of the latch orientation housing 150, which is comprised of the orientation housing 154 and the latch coupling 152. FIG. 3 and FIG. 4 both illustrate elements of the selective lockable latch tool 162 in a running configuration. Specifically, FIG. 3 will illustrate the selective lockable latch tool 162 in a running configuration positioned inside of the latch coupling 152. FIG. 4 illustrates a longitudinal cross-sectional view of a wall of the selective lockable latch tool 162, also in the running configuration. FIG. 5 illustrates the selective lockable latch tool 162 in a locked configuration positioned inside of the latch coupling 152. FIG. 6 illustrates a longitudinal view of the selective lockable latch tool 162 after it has been released from its locked configuration, denoted as the released configuration. FIG. 7 illustrates a top view of the dog segment of the selective lockable latch tool 162 if the segment was isolated. FIG. 8 illustrates a radial view of the selective lockable latch tool 162. FIG. 9 illustrates the orientation tool 164 positioned inside of the orientation housing 154. FIG. 10 illustrates the self-orienting selective lockable latch tool 160 comprising of the selective lockable latch tool 162 in the running configuration and the orientation tool 164. FIG. 11 illustrates the latch orientation housing 150 comprising of the latch coupling 152 and orientation housing 154. Finally, FIG. 12 illustrates a method of installing and using the universal self-orienting selective lockable latch system.

FIG. 2 depicts a longitudinal cross-sectional view of some of the elements of the self-orienting selective lockable latch assembly, according to some embodiments. In particular, FIG. 2 depicts a longitudinal cross-sectional view of the self-orienting selective lockable latch tool 160 fitted into the latch orientation housing 150 in a running configuration. Elements of the orientation tool 164 facilitate orientation and resistance to rotational motion of the self-orienting selective lockable latch tool 160 when run through the latch orientation housing 150. During the initial downhole operation, the self-orienting selective lockable latch tool 160 may be run into the well, which is designated as moving towards the right in this figure. A single orientation key 202 on the orientation tool 164 will be guided by an orientation muleshoe 214 until fitted into an orientation slot 204 on the orientation housing 154. Guidance of the single orientation key 202 by the orientation muleshoe 214 rotates the selective lockable latch tool 162 into a pre-set position and prevents further rotational movement while the single orientation key 202 is fitted into the orientation slot 204. Further movement of the orientation tool 164 past the orientation slot 204 may be facilitated by compression of the single orientation key 202 into an orientation key spring 218.

Rigidly attached to the orientation tool 164 is the selective lockable latch tool 162. Elements of the selective lockable latch tool 162 allows for axial locking of the self-orienting selective lockable latch tool 160 into the latch orientation housing 150. A set of circumferential latch keys 206 radially protrude from the selective lockable latch tool 162, and may be comprised of rounded, squared, planar, or curved shoulders shaped to resist moderate loading when operably engaged with a latch coupling key profile 208. The latch coupling key profile 208 may be comprised of a set of circumferential grooves on the inner surface of the latch coupling, and may be designed to match the shape and size of the set of circumferential latch keys 206. However, increased rightward loading will cause the set of circumferential latch keys 206 to flexibly compress inwards when forced into a location narrower than those allowed by the latch coupling key profile 208. Likewise, a set of movable circumferential dogs 210, which is fitted inside of slots along a lockable latch dog housing 232, may be flexibly pushed inwards when the selective lockable latch tool 162 is being run in the rightward direction. The movable circumferential dogs 210 may be distributed around the selective lockable latch tool 162 and compressed inwards when it is forced into a location with a diameter narrower than that of a latch coupling internal circumferential shoulder 212. Moreover, because both the circumferential latch keys 206 and movable circumferential dogs 210 may be reversibly compressed, a plurality of identical or unique latch couplings may be passed through without locking the selective lockable latch tool 162.

FIG. 3 depicts a longitudinal cross-sectional view of a selective lockable latch tool in a running configuration within a latch coupling, according to some embodiments. With reference to FIG. 1, FIG. 3 depicts a longitudinal cross-sectional view of the selective lockable latch tool 162 in the running configuration while fitted inside of the latch coupling 152. FIG. 4 depicts a longitudinal cross-sectional view of a wall for the selective lockable latch tool in the running configuration, according to some embodiments. With reference to FIG. 1, FIG. 4 depicts a longitudinal cross-sectional view of a wall of the selective lockable latch tool 162 in the running configuration with the same elements depicted.

During a locking operation, the first physical load change will be an upward load on the selective lockable latch tool 162. In FIG. 3 and FIG. 4, upward loading will result in loading on a load-bearing component 302. In response to the upward loading on the load-bearing component 302, the latch coupling internal circumferential shoulder 212 will push on the movable circumferential dogs 210 along the flat region of a circumferential raised element 330. This will prevent the movable circumferential dogs 210 from being pushed inwards, while a set of shear pins 324 will inhibit rightward sliding of the movable circumferential dogs 210 over the flat region of the circumferential raised element 330. The set of shear pins 324 serves as a releasable connection designed to secure attached elements in place until an amount of loading determined by the force limits of the set of shear pins 324 has been applied. Embodiments may use alternative releasable connections such as shear screws, snap rings, or shear wire. The resistance of the set of shear pins 324 will prevent leftward motion of many components in the selective lockable latch tool 162, such as an outer colleted cylindrical housing 306 and an inner mandrel 310. Moreover, the position of the circumferential latch keys 206 may allow it to become operably engaged with the latch coupling key profile 208.

Further upward loading towards the surface end (i.e., the leftward end in FIG. 3 and FIG. 4) will focus stress on a slidable support element 334 and a set of shear pins 308 attached to the slidable support element. Though not shown, the set of shear pins 308 may be attached to the inner mandrel 310. The set of shear pins 308 will prevent the slidable support element 334 from axially translating relative to the outer colleted cylindrical housing 306. Continued loading will result in shearing of the set of shear pins 308, allowing axial translation of the slidable support element 334. This slidable support element 334 may be guided during axial translation by a load-component splined element 304 attached to the load-bearing component 302, wherein the motion of the load-component splined element 304 may itself be limited to axial translation with substantially limited rotational motion by an aperture or a splined region on either the outer colleted cylindrical housing 306 or the inner mandrel 310. In some embodiments, after the shearing of the set of shear pins 308, the latch coupling key profile 208 disposed on the inner surface of the latch coupling 152 will remain engaged with the circumferential latch keys 206. This engagement may support components that are attached to the circumferential latch keys 206, such as the outer colleted cylindrical housing 306, from moving with the slidable support element 334. Once the slidable support element 334 is no longer rigidly attached to inner mandrel 310 or the outer colleted cylindrical housing 306, the slidable support element 334 may be moved in the downhole direction.

In some embodiments, upon renewed loading in the downhole direction after the shearing of the set of shear pins 308, the slidable support element 334 will slide along a second splined element 314 on the inner mandrel 310 in the rightward direction. The second splined element 314 may also be positioned as a part of the outer colleted cylindrical housing 306. The circumferential latch keys 206 may engage or continue to remain engaged with the latch coupling key profile 208, preventing components that are attached to the circumferential latch keys 206 from moving with the slidable support element 334. A set of snap rings 312 acts as fastening elements and will secure the slidable support element 334 in a support locking position 318 that will lock the slidable support element 334 in place as a locking mechanism. The position of the slidable support element 334 underneath the circumferential latch keys 206 prevents inward movement, securing both the slidable support element 334 and the selective lockable latch tool 162 against rightwards movement. Having thus been secured against both leftward and rightward motion, the selective lockable latch tool 162 may be locked in place without external application of torque.

FIG. 5 depicts a longitudinal cross-sectional view of the selective lockable latch tool in the locked configuration inside of the universal latch coupling, according to some embodiments. With reference to FIG. 1, FIG. 5 depicts a longitudinal cross-sectional view of the selective lockable latch tool 162 in the locked configuration while secured inside of the latch coupling 152. Once locked in place, it may be necessary to remove the selective lockable latch tool 162. To do so, increased upward loading is applied to the selective lockable latch tool 162. After loading the selective lockable latch tool 162 beyond the force limits of the snap rings 312, the slidable support element 334 will detach from the support locking position 318 and be pulled away from beneath the circumferential latch keys 206. After loading the selective lockable latch tool 162 beyond the force limits of the set of shear pins 324, the movable circumferential dogs 210 will be able to translate across the tangential flat region of the circumferential raised element 330. The pre-compressed spring 522 will urge the movable circumferential dogs 210 towards the right, across the circumferential raised element 330, within the confines of the lockable latch dog housing 232.

FIG. 6 depicts a longitudinal cross-sectional view of the selective lockable latch tool in a released configuration, according to some embodiments. With reference to FIG. 1, FIG. 6 depicts a longitudinal cross-sectional view of the selective lockable latch tool 162 in the released configuration. In the released configuration, the set of shear pins 324, the set of snap rings 312, and the set of shear pins 308 are all sheared. Upward loading will pull the load-bearing component 302 away from the support locking position 318, which will allow the circumferential latch keys 206 to be pushed into the selective lockable latch tool 162. The set of movable circumferential dogs 210 may be positioned such that they are no longer in contact with the circumferential raised element 330 and free to be flexibly pushed into the axis of the selective lockable latch tool 162. The selective lockable latch tool 162 may be moved once the inner mandrel 310 operatively engages with the slidable support element 334.

FIG. 7 depicts a top view of an isolated segment of the selective lockable latch tool at the dog housing, according to some embodiments. With reference to FIG. 1, FIG. 7, depicts a top view of a segment of the selective lockable latch tool 162 covered by the lockable latch dog housing 232. A set of circumferentially distributed dog housing slots 702 are radially distributed around the axis of the lockable latch dog housing 232. During an initial run-in operation before any locking activity, the movable circumferential dogs 210 may be pressed towards the set of shear pins 324 and compressed inwards without shearing or breaking any elements. When performing the lock operation, upward loading may result in the set of shear pins 324 preventing movement in the movable circumferential dogs 210. Due to the increased force experienced during upward loading of the releasing operation, the movable circumferential dogs 210 will be loaded until the set of shear pins 324 shear and the movable circumferential dogs 210 may move towards the right until they reach the boundaries of the circumferentially distributed dog housing slots 702.

FIG. 8 depicts a radial view of an orientation key fitted within a selective lockable latch, according to some embodiments. With reference to FIG. 1, FIG. 8 depicts a radial view of the selective lockable latch tool 162. In this view, the movable circumferential dogs 210 are circumferentially spaced. Behind the movable circumferential dogs 210 are the circumferential latch keys 206. The circumferential dogs may be both symmetrically and asymmetrically distributed around the axis of the selective lockable latch tool.

FIG. 9 depicts a longitudinal cross-sectional view of an orientation tool positioned within an orientation housing, according to some embodiments. With reference to FIG. 1, FIG. 9 depicts a longitudinal view of the orientation tool 164 positioned within the orientation housing 154. As the orientation tool 164 first enters the orientation housing 154, the orientation tool bottom component 968 will encounter the orientation housing top component 982. The orientation tool 164 will be guided by an initial narrower segment 980 so that the orientation tool 164 is reliably coaxial with the orientation housing 154. The single orientation key 202 may then first engage with the orientation muleshoe 214 and be guided to slide along the angle of the orientation muleshoe 214 until it reaches the orientation slot 204 within an inner muleshoe housing 976. The orientation tool 164 will be restricted from rotating once the single orientation key 202 enters the orientation slot 204. Continued axial translation in the downhole direction past the orientation slot 204 may compress the single orientation key 202 into the orientation key spring 218. Further loading in the downhole direction may allow the orientation tool 164 to completely pass through an orientation housing bottom component 978. While not shown, the orientation housing bottom component 978 may be threaded to allow the orientation housing 154 to be attached with other components in the well, such as casing.

FIG. 10 depicts a longitudinal cross-sectional view of a self-orienting selective lockable latch tool, according to some embodiments. With reference to FIG. 1, FIG. 10 depicts a longitudinal cross-sectional view of the self-orienting selective lockable latch tool 160. As previously illustrated, the self-orienting selective lockable latch tool 160 comprises the selective lockable latch tool 162 and the orientation tool 164. In this depicted example of the orientation tool 164, a top mandrel 1062 forms a cylindrical shell, on top of which an orientation key housing 1064 is placed. As the orientation tool 164 is being run into a hole, the tapered edges of an orientation tool bottom component 1068 will keep the orientation tool 164 centered when the orientation tool 164 enters a narrow region. The orientation key housing 1064 secures the single orientation key 202 as well as the orientation key spring 218 beneath the axially-aligned orientation key. During run-in operations, the single orientation key 202 will operably engage with an axially aligned orientation key profile, while the orientation key spring 218 allows compression of the single orientation key 202 under stress to allow the orientation tool 164 to clear the orientation housing. The selective lockable latch tool 162 may be rigidly attached to the orientation tool 164. Thus, torque experienced by elements of the selective lockable latch tool 162, such as the slidable support element 334, or tools attached to those elements, may be transferred onto the orientation tool 164 and any orientation housing that the single orientation key 202 is positioned in. Though not shown, spacer tubing, pipe, or beams may be used to separate the selective lockable latch tool 162 and the orientation tool 164.

FIG. 11 depicts a longitudinal cross-sectional view of a universal latch orientation housing, according to some embodiments. With reference to FIG. 1, FIG. 11, depicts a longitudinal view of the latch orientation housing 150. As previously illustrated, the latch orientation housing 150 comprises the latch coupling 152 and the orientation housing 154. While the orientation housing 154 uses an orientation muleshoe 214 with the orientation slot 204 parallel to the orientation housing axis, other self-orienting orientation housing schemes are also possible. Such orientation housing may include orientation housing comprised of multiple slots, angled slots, or threaded profiles. Though not shown, spacer casing, piping, or other tubing may be used to separate the latch coupling 152 and the orientation housing 154.

Example Operations

FIG. 12 depicts a flowchart of operations to install the casing string and universal latch orientation housing, according to some embodiments. FIG. 12, with reference to FIG. 1A, depicts a flowchart 1200 of operations to install the casing string and universal latch orientation housing, according to some embodiments. The flowchart 1200 includes example operations that can be performed by a drilling operator performing the operations at a well. Alternatively or in addition, operations of the flowchart 1200 can be performed by a well operations operator, service operator, well intervention operator, various circuitry or machinery, executable code to control the various circuitry or machinery, etc. Operations of the flowchart 1200 are described in reference to FIG. 1A and begin at block 1202.

At block 1202, the casing of the wellbore is lowered into the well with an orientation housing until the orientation housing has reached a pre-defined position. For example, with reference to FIG. 1A, the lower orientation housing 154 is lowered until it has reached a pre-defined target position.

At block 1204, a determination is made on whether a segment of a casing being inserted will be at a targeted lock position when installed in the casing. In one non-limiting example, with reference to FIG. 1A, the targeted lock position would be a position in proximity to where a whipstock is to be locked in place above the latch orientation housing 150 so that the whipstock may guide a drill bit to drill a lateral well.

In the case that the segment added will not be at the targeted lock position upon setting, the procedure will continue to block 1206 and a segment of casing will be run into the wellbore and then proceed to block 1216.

However, if the segment added will be at a targeted lock position upon setting, the procedure will move to block 1208, wherein a lower orientation housing is used in place of ordinary casing and is run into the wellbore.

At block 1210, a determination is made of whether a spacer casing is added on top of the orientation housing. In particular, a determination is made on whether the orientation housing and the latch coupling are to be directly connected or if one or more spacer casings will be inserted between the orientation housing and the latch coupling. Such spacer casing may be advantageous to enhance stability of the self-orienting selective lockable latch tool. With reference to FIG. 1A, the orientation housing 154 and latch coupling 152 are attached to the spacer casing 156. If a spacer casing is added, operations of the flowchart 1200 continue at block 1212. Otherwise, operations of the flowchart 1200 continue at block 1214.

At block 1212, the spacer casing is lowered into the wellbore to be positioned above the orientation housing. This may occur after the orientation housing has already been physically set in place, or by lowering a combined tubular assembly comprised of both the spacer casing and the orientation housing, with the orientation housing lower than the spacer casing.

At block 1214, the latch coupling is lowered into the wellbore above the orientation housing and, if present, the spacer casing. For example, with reference to FIG. 1A, after the lower orientation housing 154 and spacer casing 156 are lowered into the well, the lower latch coupling 152 is lowered into the well. This may occur after the orientation housing 154 or spacer casing 156 have already been physically set in place. This may also occur by lowering a combined assembly comprised of the latch coupling 152, with the latch coupling 152 above the orientation housing 154 and, if present, the spacer casing 156.

At block 1216, a determination is made of whether there is additional casing and/or locking assemblies to be run into the well. For example, with reference to FIG. 1A, it would be determined that there would be additional casing and locking assemblies to be run into the well after running in the latch coupling 152, and in particular the upper orientation housing 144 and upper latch coupling 142. With two latch orientation housing structures in place, lateral wells may be drilled in both the proximity of the top of the lower latch orientation housing 150 and the top of the upper latch orientation housing 140. As seen from this example, a plurality of viable self-orienting locking positions may be implemented by integrating multiple pairs of orientation housing and latch couplings as part of the casing to provide multiple locking points for whipstocks to help drill a plurality of lateral wells. For example, after installation of the lower latch orientation housing 150, the procedure would return to block 1204 and begin the same method to install the upper latch orientation.

Any combination of orientation housing, casing, or universal latch coupling, or plurality thereof, may be physically connected above the surface before being run into a well, or may be individually run into the well and connection established within the wellbore.

Figure 13:
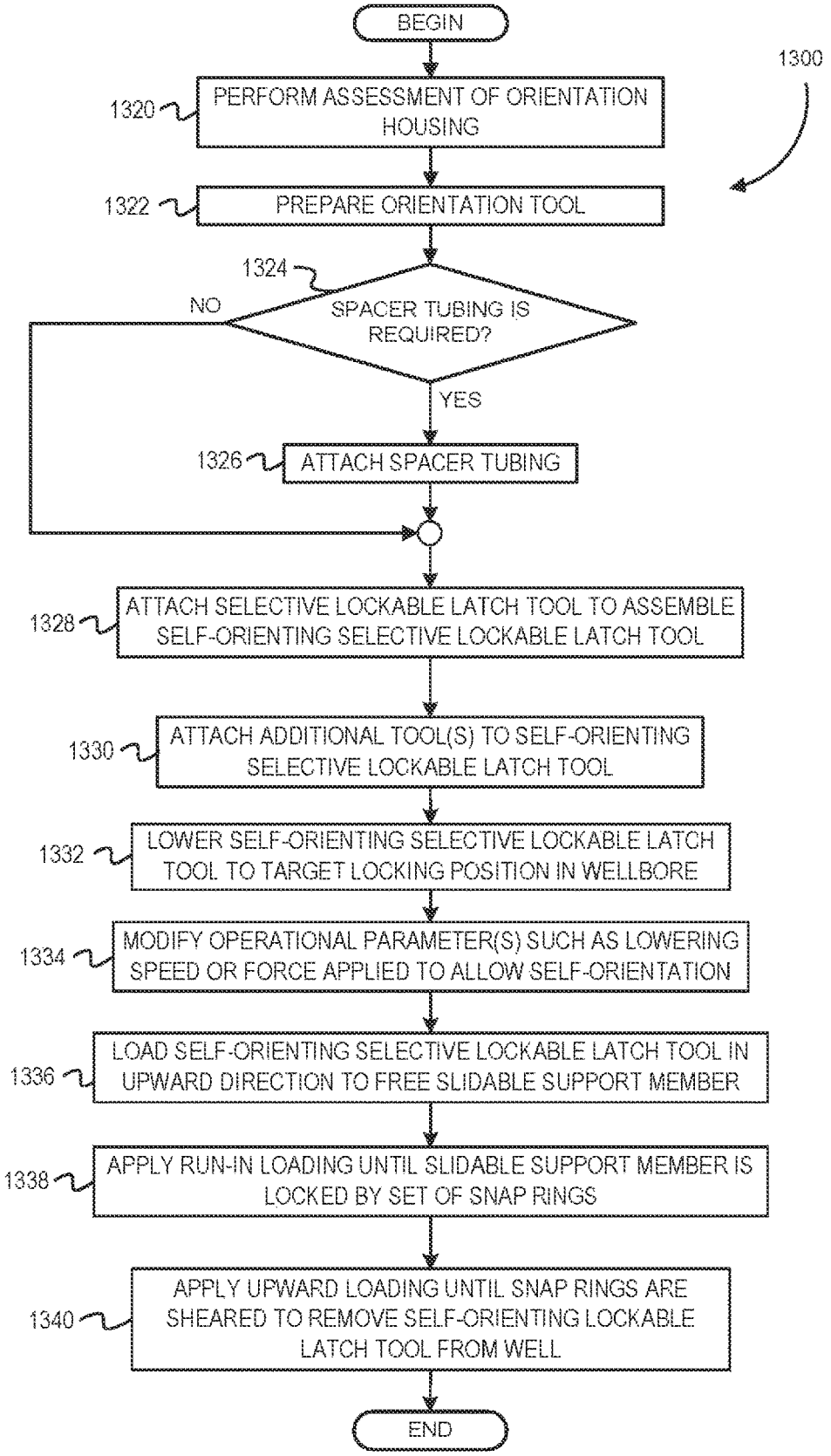
FIG. 13 depicts a flowchart of operations that include the universal self-orienting selective lockable latch assembly, according to some embodiments.

FIG. 13 depicts a flowchart of operations that include the universal self-orienting selective lockable latch assembly, according to some embodiments. FIG. 13, with references to FIG. 1 and FIG. 3, depicts a flowchart 1300 of operations that include the universal self-orienting selective lockable latch assembly, according to some embodiments.

Upon installation of latch coupling and orientation housing into the well, there may be an assessment of the orientation at least one of the orientation housing at 1320. Such an assessment can be performed through use of a dummy tool, MWD equipment, or with a universal bottom-hole orientation tool. At 1322, the orientation tool 164 is selected and prepared to be run in based on the known properties of the orientation housing 154. At 1324, it is determined whether the orientation tool 164 and the selective lockable latch tool 162 are to be directly connected or if spacer tubing is required to ensure that the orientation tool 164 may be positioned into the orientation housing 154 while the selective lockable latch tool 162 is positioned in the latch coupling 152.

If spacer tubing is required, then the spacer tubular 166 will be attached between the orientation tool 164 and the selective lockable latch tool 162 at block 1326. After the spacer tubular 166 is attached to the orientation tool 164, the selective lockable latch tool 162 is attached to the spacer tubing at 1328 to form the self-orienting selective lockable latch tool 160. If spacer tubing will not be used between the orientation tool selective lockable latch tool, then a selective lockable latch tool is attached directly to the orientation tool at 1328, assembling a self-orienting selective lockable latch tool without spacer tubing.

At 1330, a drilling operator may optionally attach one or more additional tools to the self-orienting selective lockable latch tool 160. The self-orienting selective lockable latch tool 160 may then be run into the well until a target locking position is reached by the tool at 1332. At 1334, the operational parameters such as lowering speed or force applied may be modified to allow the lockable latch tool 160 to self-orient. Then at 1336, upward loading substantially parallel to the wellbore axis is applied on the self-orienting selective lockable latch tool 160 to free the slidable support element 334 from its first position. Once the slidable support element 334 is first freed, we apply run-in loading from the surface until the slidable support element 334 is locked into the support locking position 318 by the set of snap rings 312 during a second locking step 1338. At 1340, the self-orienting selective lockable latch tool 160 is removed from the well by applying upward loading from the surface until both the set of snap rings 312 and the set of shear pins 324 are sheared and the tool is pulled back towards the wellbore surface.

Example Embodiments

Some embodiments may include an apparatus comprising a cylindrical housing with a circumferential radially compressible protrusion, a mandrel coaxial with the cylindrical housing and forming an annular volume between an inner surface of the cylindrical housing and the mandrel, a circumferential support element that is at least partially within the annular volume that is to reinforce the circumferential radially compressible protrusion against compression, and a movable circumferential dog attached coaxially to the cylindrical housing and is reversibly compressible into an axis of the cylindrical housing.

In some embodiments, the circumferential radially compressible protrusion has a planar face with a surface norm facing towards one end of the cylindrical housing.

In some embodiments, the apparatus further comprises of a circumferential component attached to the circumferential support element, wherein the circumferential component is to slidably move along the axis of the cylindrical housing.

In some embodiments, the apparatus further comprises of a first splined element is attached to at least one of the circumferential support element and the circumferential component, the first splined element to operably engage with a second splined element attached to at least one of the cylindrical housing and the mandrel to limit rotational movement of the circumferential support element.

In some embodiments, the apparatus further comprises of a first releasable connection element that fastens the circumferential support element to a locked position within the annular volume where the circumferential support element reinforces the circumferential radially compressible protrusion against radial compression, and a second releasable connection element that fastens the circumferential support element to an unlocked position within the annular volume where the circumferential support element does not reinforce the circumferential radially compressible protrusion against radial compression.

In some embodiments, the first releasable connection element is a shear pin and the second releasable connection element is a snap ring.

In some embodiments, the apparatus further comprises of a circumferential raised element radially beneath the dog housing tubular assembly and positioned to physically reinforce the movable circumferential dog against radial compression, a first surface of the circumferential raised element with a first surface norm facing radially away from a first axial direction, and a second surface of the circumferential raised element with a second surface norm facing towards the first axial direction.

In some embodiments, the apparatus further comprises of a compressed spring positioned to move the movable circumferential dog axially upon shearing of the third releasable connection element.

In some embodiments, a system comprises of a first tubular housing with a circumferential latch profile and an internal circumferential shoulder disposed on an inner surface of the first tubular housing, a second tubular housing attached to one end of the first tubular housing, with at least one orientation profile disposed on an inner surface of the second tubular housing, an orientation tool positionable within the second tubular housing, wherein a protrusion is operably engageable with the orientation profile of the second tubular housing, a cylindrical housing with a circumferential radially compressible protrusion that is attached to the orientation tool, a mandrel coaxial with the cylindrical housing and forming an annular volume between the inner surface of the cylindrical housing and the mandrel, a circumferential support element that is at least partially within the annular volume that reinforces the circumferential radially compressible protrusion against compression; and a movable circumferential dog attached coaxially to the cylindrical housing and is reversibly compressible into the axis of the cylindrical housing.

In some embodiments, the system further comprises of a muleshoe attached to the inner surface of the second tubular housing, an orientation profile disposed on the inner surface of the second tubular housing and parallel to the axis of the second tubular housing; and the orientation tool, wherein the orientation tool possesses a single orientation protrusion that is shaped to operably engage with the orientation profile.

In some embodiments, a first length of casing string is positioned between the first tubular housing and second tubular housing and a second length of tubing is positioned between the orientation tool and the cylindrical housing.

In some embodiments, the system further comprises of a first releasable connection element that fastens the circumferential support element to a locked position within the annular volume where the circumferential support element reinforces the circumferential radially compressible protrusion against radial compression, and a second releasable connection element that fastens the circumferential support element to an unlocked position within the annular volume where the circumferential support element does not reinforce the circumferential radially compressible protrusion against radial compression.

In some embodiments, the circumferential latch profile further comprises of a set of circumferential grooves that operably engages with the circumferential radially compressible protrusion.

In some embodiments, the system further comprises of an upper tubular housing with an upper circumferential latch profile that operably engages with the circumferentially radially compressible protrusion.

In some embodiments, the system further comprises of an upper tubular housing with an upper circumferential latch profile that operably engages with the circumferentially radially compressible protrusion.

In some embodiments, a method comprises of lowering a well tool with a cylindrical housing into a well until the cylindrical housing is positioned inside of a first tubular housing, applying an axial upward load on the well tool to operably engage a movable circumferential dog attached to the well tool with an internal shoulder attached to an inner surface of the first tubular housing, applying axial upward load on the well tool to release a first releasable connection element that is fastening a circumferential support element to an unlocked position within an annular volume inside of the well tool, and applying axial run-in load on the well tool to slidably move the circumferential support element until a second releasable connection element fastens the circumferential support element to a locked position in the annular volume and supports a circumferential radially compressible protrusion on the cylindrical housing against compressing inwards.

In some embodiments, the method further comprises of running the well tool to an upper tubular housing, wherein the circumferential radially compressible protrusion operably engages with an upper circumferential latch profile on the upper tubular housing, and running the well tool through the upper tubular housing until it reaches the first tubular housing.

In some embodiments, the method further comprises of applying axial upward load on the circumferential support element to release the second releasable connection element that is fastening the circumferential support element.

In some embodiments, the method further comprises of applying axial upward load on the circumferential support element to release a third releasable connection element attached to the movable circumferential dog that is fastening the movable circumferential dog.

In some embodiments, the method further comprises of using an orientation tool attached to the cylindrical housing to operatively engage with an orientation profile of an orientation tubular.

In some embodiments, the method further comprises of attaching a third tool above the cylindrical housing such that torque experienced by the third tool is transferred to the orientation tool.

Plural instances may be provided for components, operations or structures described herein as a single instance. For example, while two sets of latch orientation housings are shown in FIG. 1, a well system may comprise any number latch orientation housings. Finally, boundaries between various components and operations are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Unless otherwise specified, any use of any form of the terms "connect," "engage," "couple," "attach," or any other term describing an interaction between elements is not meant to limit the interaction to direct interaction between the elements and may also include indirect interaction between the elements described. In the preceding discussion and in the claims, the description refers to up or down as relative directions and not absolute directions. The terms "up," "upper," "upward," or "pick-up direction" describe a direction toward the surface of a wellbore regardless of the wellbore orientation. Similarly, the terms "down," "lower," "downward," "downhole direction", or "run-in direction" describe a direction toward the terminal end of a wellbore regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The term "circumferential latch keys" can mean both a set of continuous collets surrounding a cylinder or a set of distributed circumferential shapes that are rotationally symmetric. The various characteristics mentioned above, as well as other features and characteristics described in more detail above, will be readily apparent to those skilled in the art with the aid of this disclosure upon reading the following detailed description of the embodiments, and by referring to the accompanying drawings.

The invention claimed is:

1. a system comprising:

a selective lockable latch tool comprising:

a cylindrical housing having a circumferential radially compressible protrusion on an external surface of the cylindrical housing, wherein the circumferential radially compressible protrusion is to engage a latch key profile after the system is positioned at a location in a wellbore;

a mandrel within the cylindrical housing and defining an annular volume between an inner surface of the cylindrical housing and an outer surface of the mandrel; and a circumferential support element at least partially within the annular volume and movable between an unlocked position and a locked position, wherein, in the locked position, the circumferential support element is to reinforce the circumferential radially compressible protrusion;

a movable circumferential dog attached coaxially to the cylindrical housing, wherein the movable circumferential dog is reversibly compressible into an axis of the cylindrical housing; and an orientation tool coupled with the selective lockable latch tool, the orientation tool comprising:

a radially compressible orientation key that is to engage an orientation slot of a tubular in the wellbore after the system is positioned at the location in the wellbore.

2. The system of claim 1, wherein the selective lockable latch tool comprises:

a first releasable connection element connected to the movable circumferential dog, wherein the first releasable connection element restricts axial movement of the movable circumferential dog prior to shearing of the first releasable connection element.

3. The system of claim 2, wherein the selective lockable latch tool comprises:

a dog housing coupled to the cylindrical housing, wherein at least a portion of the movable circumferential dog protrudes from a circumferential slot of the dog housing in response to shearing of the first releasable connection element.

4. The system of claim 2, wherein the selective lockable latch tool comprises:

a compressed spring positioned to move the movable circumferential dog axially upon shearing of the first releasable connection element.

5. The system of claim 2, wherein the selective lockable latch tool comprises:

a second releasable connection element, wherein the second releasable connection element restricts axial movement of the circumferential support element when the circumferential support element is in the locked position.

6. The system of claim 5, wherein the selective lockable latch tool comprises:

a third releasable connection element, wherein the third releasable connection element restricts axial movement of the circumferential support element when the circumferential support element is in the unlocked position.

7. The system of claim 1, wherein the selective lockable latch tool comprises:

a circumferential component attached to the circumferential support element, wherein the circumferential component is to slidably move along the mandrel.

8. A system comprising:

one or more tubulars positioned within a wellbore, wherein a circumferential latch profile and an orientation profile is disposed on an inner surface of the one or more tubulars; and a downhole tool comprising:

a selective lockable latch tool comprising, a cylindrical housing having one or more circumferential radially compressible protrusions disposed on an external surface of the cylindrical housing, wherein the one or more circumferential radially compressible protrusions are to engage the circumferential latch profile when the downhole tool is positioned within the wellbore;

a mandrel within the cylindrical housing and defining an annular volume between an inner surface of the cylindrical housing and an outer surface of the mandrel;

a circumferential support element at least partially within the annular volume and movable between an unlocked position and a locked position, wherein, in the locked position, the circumferential support element prevents inwards compression of the one or more circumferential radially compressible protrusions of the cylindrical housing;

a dog housing coupled to the cylindrical housing; and one or more circumferential dogs at least partially within the dog housing, wherein the one or more circumferential dogs are radially compressible and axially movable; and an orientation tool coupled with the selective lockable latch tool and having an orientation key that is to engage the orientation profile when the downhole tool is positioned within the wellbore.

9. The system of claim 8, wherein the circumferential latch profile comprises a set of circumferential grooves that are to engage the one or more circumferential radially compressible protrusions of the downhole tool when the downhole tool is positioned within the wellbore.

10. The system of claim 8, wherein the one or more tubulars comprises:

a muleshoe having an angled profile, wherein the orientation key is to slide along the angled profile as the downhole tool is positioned prior to engaging the orientation profile.

11. The system of claim 8, wherein the selective lockable latch tool comprises:

a first releasable connection element that fastens the circumferential support element in the locked position within the annular volume; and a second releasable connection element that fastens the circumferential support element in the unlocked position within the annular volume, wherein, in the unlocked position, the circumferential support element does not reinforce the one or more circumferential radially compressible protrusions against radial compression.

12. The system of claim 8, wherein the circumferential latch profile is disposed on a first tubular of the one or more tubulars and wherein the orientation profile is disposed on a second tubular of the one or more tubulars.

13. The system of claim 8, wherein the dog housing comprises:

a shearing element connected to the one or more circumferential dogs; and a plurality of slots in the dog housing, wherein the one or more circumferential dogs are to engage the plurality of slots in response to shearing of the shearing element.

14. The system of claim 8, wherein the selective lockable latch tool comprises:

a circumferential component attached to the circumferential support element, wherein the circumferential component is to slidably move along the mandrel.

15. A method comprising:

lowering a well tool through one or more tubular housings positioned within a well, wherein a circumferential support element is secured in an unlocked position in an annular volume within a cylindrical housing of the well tool by a first releasable connection element;

in response to an orientation tool of the well tool engaging with an orientation profile of a first tubular housing of the one or more tubular housings within the well, applying a first axial upward load on the well tool to engage a movable circumferential dog attached to the well tool with an internal shoulder on an inner surface of the one or more tubular housings within the well;

applying a second axial upward load on the well tool until the first releasable connection element releases; and applying an axial run-in load on the well tool until a second releasable connection element secures the circumferential support element in a locked position in the annular volume where the circumferential support element supports a circumferential radially compressible protrusion of the cylindrical housing against compression.

16. The method of claim 15, further comprising:

applying a third axial upward load on the well tool until the second releasable connection element releases.

17. The method of claim 15, further comprising:

applying a third axial upward load on the well tool until a third releasable connection element releases, wherein prior to applying the third axial upward load, the third releasable connection element secures the movable circumferential dog against axial movement.

18. The method of claim 15, wherein lowering the well tool comprises:

lowering the well tool through the one or more tubular housings until the circumferential radially compressible protrusion of the cylindrical housing operably engages with a circumferential latch profile on the inner surface of the one or more tubular housings.

19. The method of claim 15, wherein the orientation tool of the well tool comprises an orientation key, wherein lowering the well tool comprises:

lowering the well tool through the one or more tubular housings until the orientation key of the orientation tool engages with the orientation profile of the first tubular housing.

* * * * *